US006783214B2

(12) United States Patent
Sakuma

(10) Patent No.: US 6,783,214 B2
(45) Date of Patent: Aug. 31, 2004

(54) INKJET HEAD HAVING A PLURALITY OF PRESSURE CHAMBERS

(75) Inventor: Mikio Sakuma, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 48 days.

(21) Appl. No.: 10/305,947

(22) Filed: Nov. 29, 2002

(65) Prior Publication Data

US 2003/0103117 A1 Jun. 5, 2003

(30) Foreign Application Priority Data

Nov. 30, 2001 (JP) ..... 2001-365513

(51) Int. Cl.[7] ..... B41J 2/045
(52) U.S. Cl. ..... 347/72
(58) Field of Search ..... 347/68, 70–72; 310/328; 29/25.35, 890.1

(56) References Cited

U.S. PATENT DOCUMENTS 5,128,694 A * 7/1992 Kanayama ..... 347/72
5,402,159 A * 3/1995 Takahashi et al. ..... 347/9
5,639,508 A * 6/1997 Okawa et al. ..... 427/100
5,758,396 A 6/1998 Jeon et al.
6,079,820 A 6/2000 Dijksman et al.
6,223,405 B1 5/2001 Oikawa et al.

FOREIGN PATENT DOCUMENTS

EP 0 976 560 A2 2/2000
EP 1 057 643 A2 12/2000
JP A 4-341852 11/1992

* cited by examiner

*Primary Examiner*—Judy Nguyen
(74) *Attorney, Agent, or Firm*—Oliff & Berridge, PLC

(57) ABSTRACT

An inkjet head provided with a plurality of pressure chambers includes an actuator unit for the plurality of pressure chambers. The actuator unit includes a plurality of inactive layers and at least one active layer, both made of piezoelectric material. The plurality of inactive layers are arranged on a pressure chamber side to cover the plurality of pressure chambers. The at least one active layer is arranged on an opposite side of the pressure chambers with respect to the inactive layers. The active layer is segmented to a plurality of segments which are located at positions correspond to the plurality of pressure chambers. Further, each segment of the active layer is sandwiched between a common electrode and a driving electrode.

16 Claims, 7 Drawing Sheets

INKJET HEAD HAVING A PLURALITY OF PRESSURE CHAMBERS

BACKGROUND OF THE INVENTION

The present invention relates to an inkjet head for an inkjet printing apparatus.

Recently, inkjet printing apparatuses are widely used. An inkjet head (i.e., a printing head) employed in an inkjet printing apparatus is configured such that ink is supplied from an ink tank into manifolds and distributed to a plurality of pressure chambers defined in the inkjet head. By selectively applying pressure to the pressure chambers, ink is selectively ejected through the nozzles, which are defined corresponding to the pressure chambers, respectively. For selectively applying pressure to respective pressure chambers, an actuator unit composed of laminated sheets of piezoelectric ceramic is widely used.

An example of such an inkjet head is disclosed in U.S. Pat. No. 5,402,159, teachings of which are incorporated herein by reference. The above-described patent discloses an inkjet head which includes an actuator unit having ceramic layers which are consecutive laminated planes extending over a plurality of pressure chambers. In the inkjet head of the above-mentioned patent, the piezoelectric ceramic layers of the actuator unit generally include active layers and inactive layers. The active layers are located at the pressure chamber side and sandwiched between a common electrode kept at a ground potential and driving electrodes (individual electrodes) respectively located at places corresponding to the pressure chambers. The inactive layers are located on a side opposite to the pressure chambers and are not provided with electrodes. By selectively controlling the potential of the driving electrodes to be different from that of the common electrodes, the active layers expand/contract in the stacked direction of the layers in accordance with a piezoelectric longitudinal effect. With this expansion/contraction of the active layers, the volume within the corresponding pressure chambers varies, thereby ink being selectively ejected from the pressure chambers. The inactive layers deform very little and serve to support the active layers from above so that the active layers effectively expand/contract in the stacked direction of the layers.

Recently, there is a great demand for highly integrated pressure chambers. However, the inkjet head of the type as described in the above-mentioned patent is insufficient to meet such a demand.

SUMMARY OF THE INVENTION

In view of the above, the present invention is advantageous in that an inkjet head having highly integrated pressure chambers is provided.

According to an aspect of the invention, there is provided an inkjet head, which is provided with a plurality of pressure chambers, each of which being configured such that an end thereof is connected to a discharging nozzle and the other end is connected to an ink supplier, and an actuator unit for the plurality of pressure chambers. Specifically, the actuator unit includes a plurality of inactive layers and at least one active layer, both made of piezoelectric material. The plurality of inactive layers are arranged on a pressure chamber side to cover the plurality of pressure chambers. The at least one active layer is arranged on an opposite side of the pressure chambers with respect to the inactive layers. In an embodiment, the active layer is segmented to a plurality of segments which are located at positions correspond to the plurality of pressure chambers. Further, each segment of the active layer is sandwiched between a common electrode and a driving electrode.

Optionally, when a driving electrode provided on a segment of the active layer is set to have a voltage different from the potential of the common electrode, the segment of the active layer deforms in accordance with piezoelectric transverse effect. In this case, a unimorph effect is generated by the deformation of the segment of the active layer in association with the inactive layers to vary a volume of the pressure chamber corresponding to the segment.

Optionally, at least one layer includes a plurality of active layers.

Further optionally, an electrode arranged farthest from the pressure chamber may be configured to be the thinnest electrode between the common electrode and the driving electrode.

In an embodiment of the invention, an electrode closest to the pressure chamber is the common electrode.

In a particular case, a thickness of each of the at least one active layer is 20 $\mu$m or less.

In an embodiment, condition:

$$t/T \leqq 0.8$$

is satisfied, wherein, t represents a thickness of the active layer, and T represents the entire thickness of the active layer and the inactive layers. More preferably, t/T may be 0.7 or less.

Further, conditions:

$$0.1 \text{ mm} \leqq L_0 \leqq 1 \text{ mm},$$

and $$0.3 \leqq \delta L_0 \leqq 1,$$

may be satisfied, wherein $L_0$ represents a width of the active layer in a shorter side, and wherein $\delta$ represents a width of a driving electrode in a direction similar to the width L of the active layer.

Still optionally, all of the at least one active layer and the at least one inactive layer may be formed of the same material.

Optionally or alternatively, all of the at least one active layer and the inactive layers have substantially the same thickness.

In an embodiment, the number of the active layer and the number of the inactive layers are one and two, respectively. Alternatively, the number of the active layers and the number of the inactive layers can be two and two, respectively.

Still optionally, the common electrode may be kept to a ground potential.

According to another aspect of the invention, there is provided an inkjet head, which is provided with a plurality of pressure chambers, each of which being configured such that an end thereof is connected to a discharging nozzle and the other and is connected to an ink supplier, and an actuator unit for the plurality of pressure chambers. Further, the actuator unit includes a plurality of inactive layers arranged on a pressure chamber side and formed of piezoelectric material and at least one active layer arranged on an opposite side of the pressure chambers with respect to the inactive layers and formed of piezoelectric material, the plurality of inactive layers being arranged to cover the plurality of pressure chambers, the at least one active layer being segmented to locate at positions corresponding to the plurality of pressure chambers. Furthermore, each segment of the at least one active layer is sandwiched between a common electrode and a driving electrode, and each segment of the at least one active layer sandwiched between the common electrode and the driving electrode deforms in accordance with piezoelectric transverse deformation effect so that the each segment performs unimorph deformation in accordance with a voltage applied to each of the driving electrode. Optionally, the common electrode may be kept to a ground potential.

BRIEF DESCRIPTION OF THE ACCOMPANYING DRAWINGS

DETAILED DESCRIPTION OF THE EMBODIMENT

Hereinafter, a preferred embodiment of the invention will be described with reference to the drawings.

Figure 1:
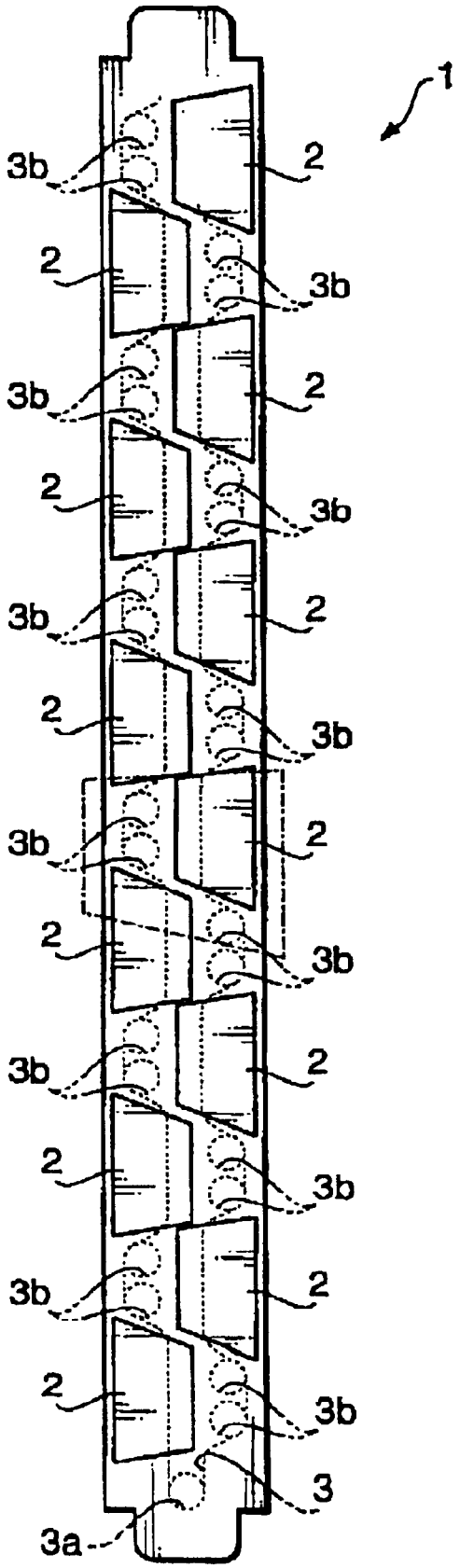
FIG. 1 is a bottom view of an inkjet head according to an embodiment of the invention.
Figure 2:
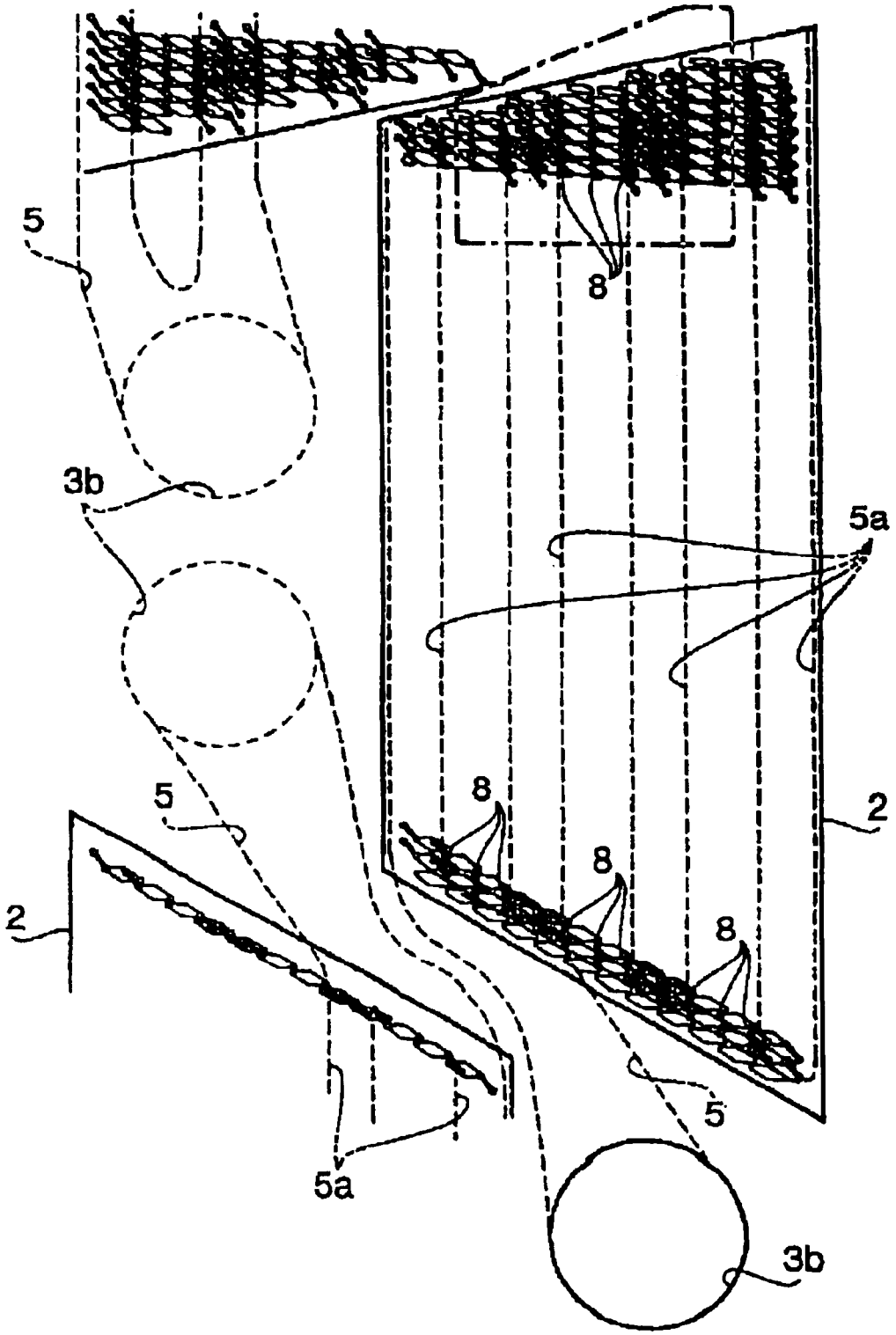
FIG. 2 is an enlarged view of an area surrounded by a dashed line in FIG. 1.
Figure 3:
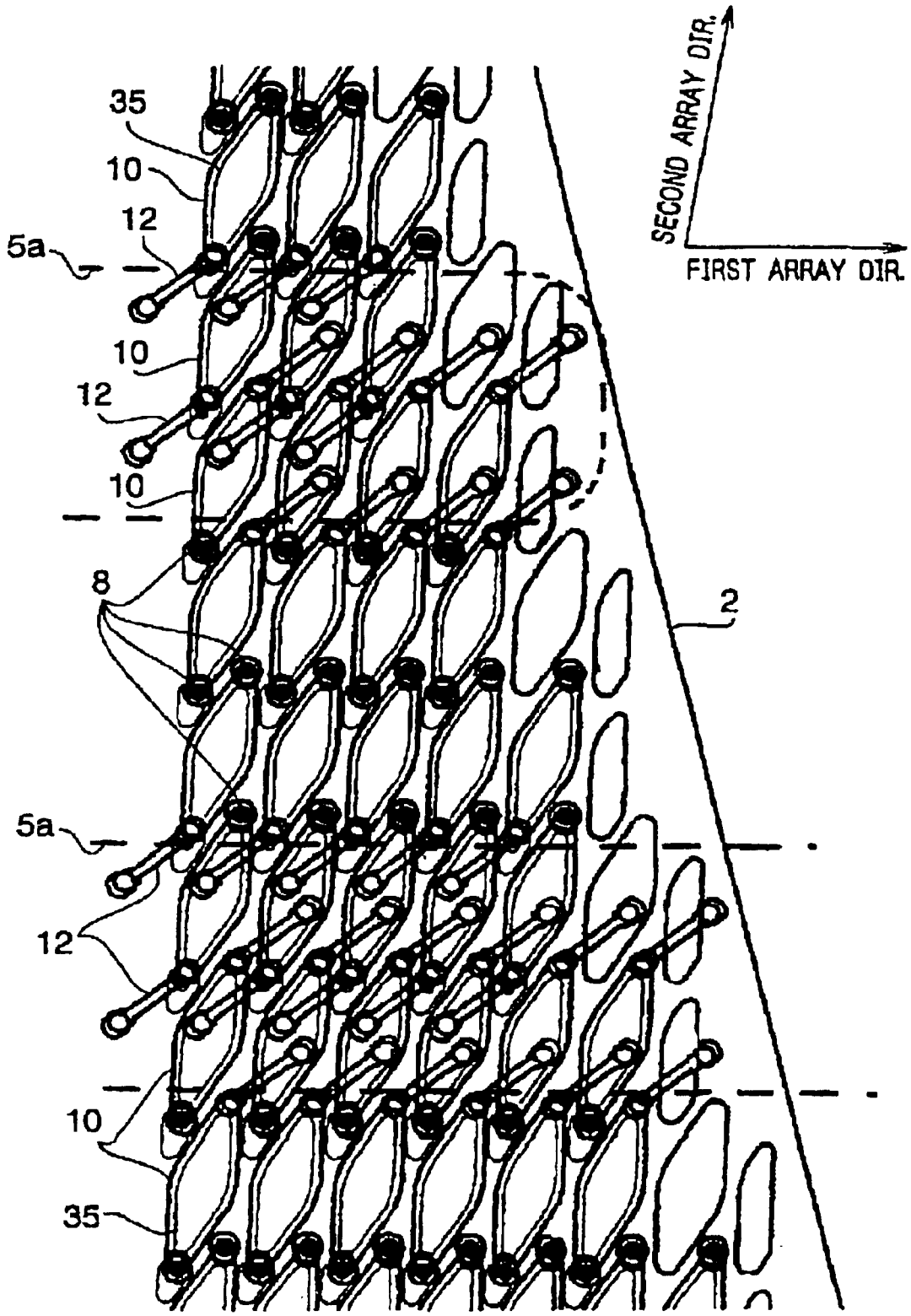
FIG. 3 is an enlarged view of an area surrounded by a dashed line in FIG. 2.
Figure 4:
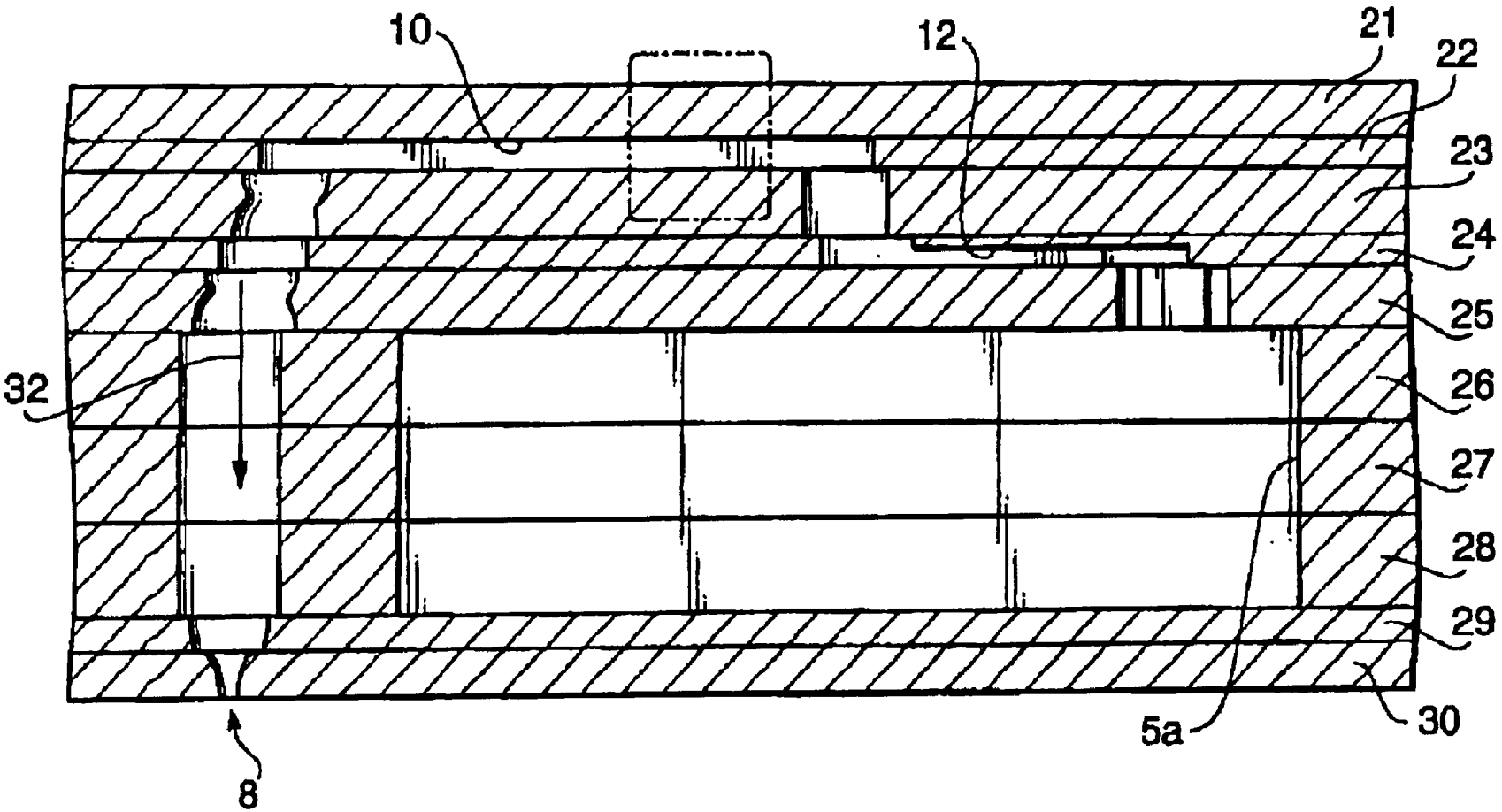
FIG. 4 is a sectional view of a primary part of the inkjet head shown in FIG. 1.
Figure 5:
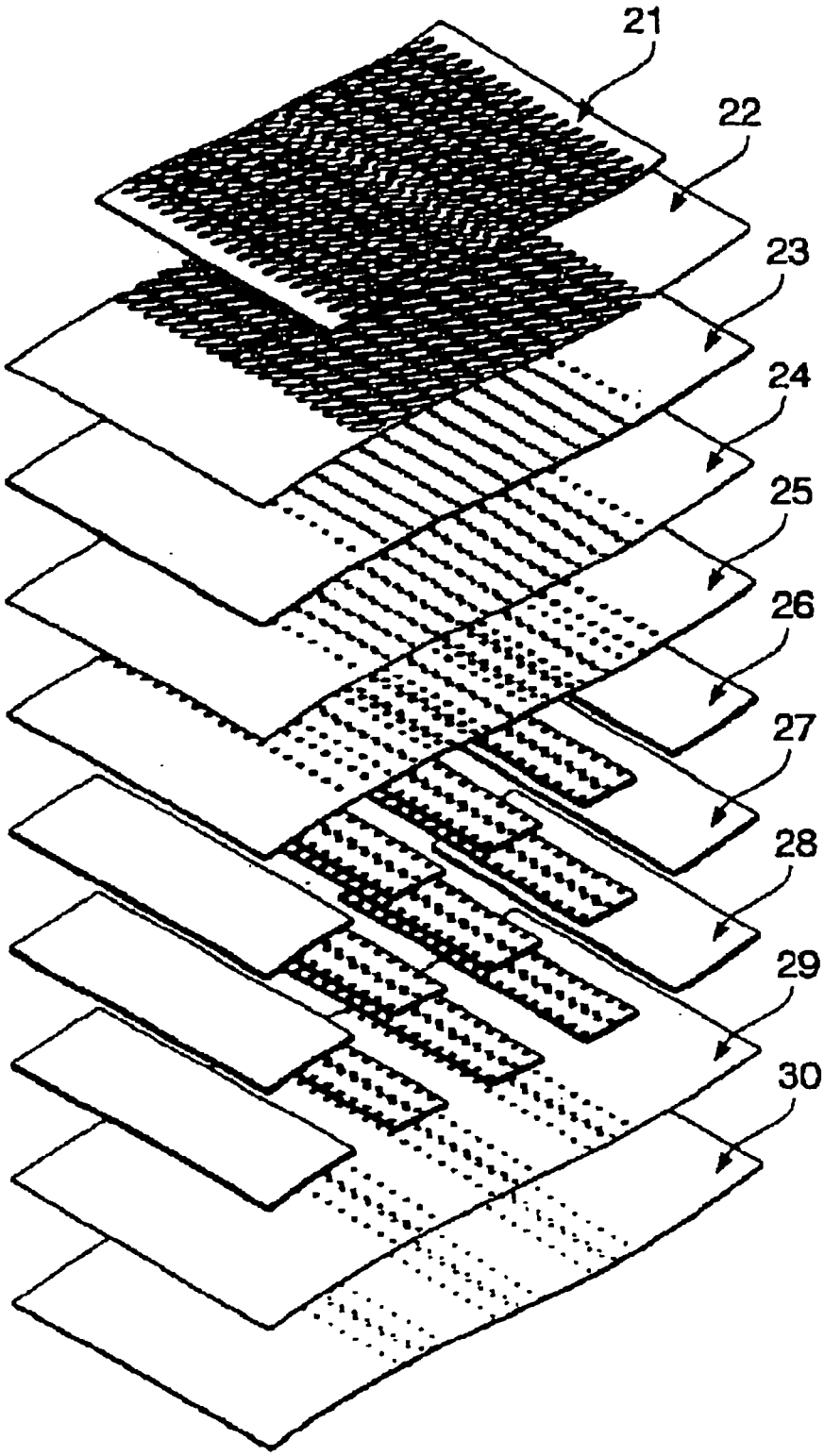
FIG. 5 is an exploded perspective view of the primary part of the inkjet head shown in FIG. 1.
Figure 6:
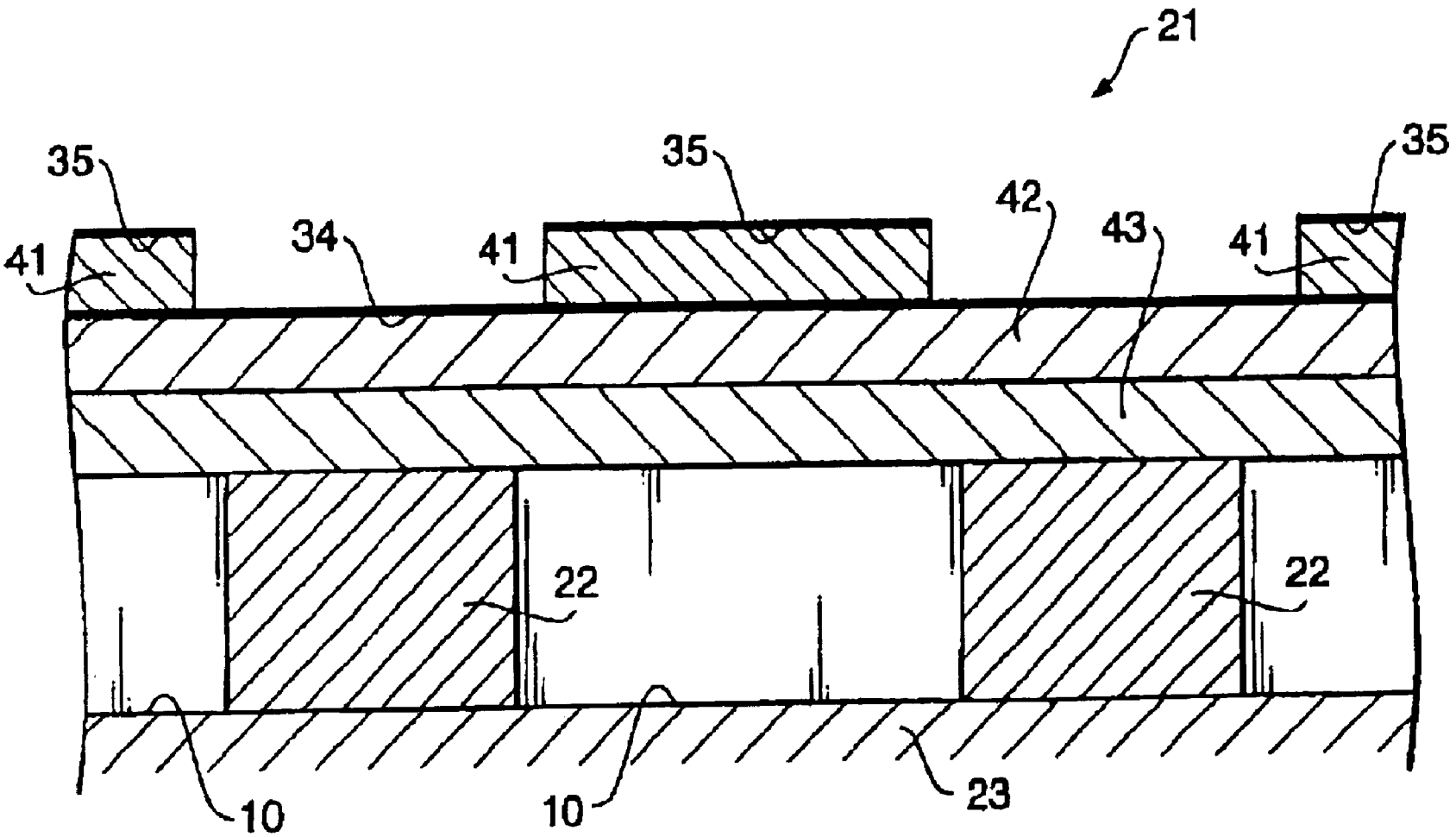
FIG. 6 is an enlarged side view of an area surrounded by a dashed line in FIG. 4.

FIG. 1 is a bottom view of an inkjet head 1 according to an embodiment of the invention. FIG. 2 is an enlarged view of an area surrounded by a dashed line in FIG. 1. FIG. 3 is an enlarge view of an area surrounded by a dashed line in FIG. 2. FIG. 4 is a sectional view of a primary part of the inkjet head 1 shown in FIG. 1. FIG. 5 is an exploded perspective view of the main part of the inkjet head shown in FIG. 1. FIG. 6 is an enlarged side view of an area surrounded by a dashed line in FIG. 4.

The inkjet head 1 is employed in an inkjet printing apparatus, which records an image on a sheet by ejecting inks in accordance with an image data. As shown in FIG. 1, the inkjet head 1 according to the embodiment has, when viewed from the bottom, a substantially rectangular shape elongated in one direction (which is a main scanning direction of the inkjet printing apparatus). The bottom surface of the inkjet head 1 is formed with a plurality of trapezoidal ink ejecting areas 2 which are arranged in two lines which extend in the longitudinal direction (i.e., the main scanning direction) of the inkjet head 1, and are also staggering (i.e., alternately arranged on the two lines).

A plurality of ink discharging openings 8 (see FIGS. 2 and 3) are arranged on the surface of each ink ejecting area 2 as will be described later. An ink reservoir 3 is defined inside the inkjet head 1 along the longitudinal direction thereof. The ink reservoir 3 is in communication with an ink tank (not shown) through an opening 3*a*, which is provided at one end of the ink reservoir 3, thereby the ink reservoir 3 being filled with ink all the time. A plurality of pairs of openings 3*b* and 3*b* are provided to the ink reservoir 3 along the elongated direction thereof (i.e., the main scanning direction), in a staggered arrangement. Each pair of openings 3*b* and 3*b* are formed in an area where the ink ejecting areas 2 are not formed when viewed from the bottom.

As shown in FIGS. 1 and 2, the ink reservoir 3 is in communication with an underlying manifold 5 through the openings 3*b*. Optionally, the openings 3*b* may be provided with a filter for removing dust in the ink passing therethrough. The end of the manifold 5 branches into two sub-manifolds 5*a* and 5*a* (see FIG. 2). The two sub-manifolds 5*a* and 5*a* extend into the upper part of the ink ejecting area 2 from each of the two openings 3*b* and 3*b* which are located besides respective ends of an ink ejecting area 2 in the longitudinal direction of the inkjet head 1. Thus, in the upper part of one ink ejecting area 2, a total of four sub-manifolds 5*a* extend along the longitudinal direction of the inkjet head 1. Each of the sub-manifolds 5*a* is filled with ink supplied from the ink reservoir 3.

As shown in FIGS. 2 and 3, a plurality of ink discharging openings 8 are arranged on the surface of each ink ejecting area 2. As shown in FIG. 4, each of the ink ejecting openings 8 is formed as a nozzle having a tapered end, and is in communication with the sub-manifold 5*a* through an aperture 12 and a pressure chamber (cavity) 10. The pressure chamber 10 has a planar shape which is generally a rhombus (900 $\mu$m long and 350 $\mu$m wide). An ink channel 32 is formed to extend, in the inkjet head 1, from the ink tank to the ink ejecting opening 8 through the ink reservoir 3, the manifold 5, the sub-manifold 5*a*, the aperture 12 and the pressure chamber 10. It should be noted that, in FIGS. 2 and 3, the pressure chambers 10 and the apertures 12 are drawn in solid lines for the purpose of clarity although they are formed in the interior of the ink ejecting area 2 and therefore should normally be drawn by broken lines.

Further, as can be seen in FIG. 3, the pressure chambers 10 are arranged close to each other within the ink ejecting area 2 so that an aperture 12, which is in communication with one pressure chamber 10 overlaps the adjacent pressure chamber 10. Such an arrangement can be realized since the pressure chambers 10 and the apertures 12 are formed at different levels (heights), as shown in FIG. 4. The pressure chambers 10 can be arranged dense so that high resolution images can be formed with the inkjet head 1 occupying an relatively small area.

The pressure chambers 10 are arranged within the ink ejecting areas 2, which are within the plane shown in FIG. 2, along two directions, i.e., the longitudinal direction of the inkjet head 1 (first array direction) and a direction slightly inclined with respect to a width direction of the inkjet head 1 (second array direction). The ink ejecting opening 8 is arranged with a density of 50 dpi in the first array direction. There are twelve pressure chambers 10 at the maximum in the second array direction are arranged such that twelve pressure chambers 10, at maximum, are arranged in the second align direction. It should be noted that a relative displacement of a pressure chamber 10 located at one end of the array of 12 pressure chambers 10 and another pressure chamber 10 at the other end of the array corresponds to a size of the pressure chamber 10 in the first array direction. Thus, between two ink ejecting openings 8 adjacently arranged in the first array direction, twelve ink ejecting openings 8 exist although they are different in positions in the width direction of the inkjet head 1. It should be noted that, in arrays on the peripheral portion in the first direction, the number of the pressure chambers 10 is less than twelve. However, the peripheral portion of the next ejecting area 2 (the arrays thereof opposing the arrays having less than twelve pressure chambers 10) is configured to compensate for each other, and thus, as the inkjet head 1 as a whole, the above condition is satisfied.

Thus, the inkjet head 1 according to the embodiment is capable of performing printing with a resolution of 600 dpi in the main scanning direction by ejecting ink from the plurality of ink ejecting openings 8 arranged in the first and second array directions in accordance with the movement of the inkjet head 1 in the width direction relative to a sheet.

Next, the sectional configuration of the inkjet head 1 will be described. As shown in FIGS. 4 and 5, the main part at the bottom side of the inkjet head 1 has a laminated structure in which a total of ten sheet members are laminated. The ten sheet members are the actuator unit 21, a cavity plate 22, a base plate 23, an aperture plate 24, a supplier plate 25, manifold plates 26, 27, 28, a cover plate 29, and a nozzle plate 30, in this order from the top.

The actuator unit 21 is configured, as will be described later in more detail, such that three piezoelectric sheets are laminated. Electrodes are provided to the actuator unit 21 so that one of the sheets are active and the other two are inactive. The cavity plate 22 is a metal plate provided with a plurality of openings of generally rhombus shape to form the pressure chamber 10. The base plate 23 is a metal plate including, for each pressure chamber 10 of the cavity plate 22, a communication hole for connecting the pressure chamber 10 and the aperture 12 and a communication hole extending from the pressure chamber 10 toward the ink ejecting opening 8. The aperture plate 24 is a metal plate including, in addition to the apertures 12, a communication hole extending from the pressure chamber 10 to the ink ejecting opening 8 for each pressure chamber 10 of the cavity plate 22. The supplying plate 25 is a metal plate including, for each pressure chamber 10 of the cavity plate 22, a communication hole for connecting the aperture 12 and the sub-manifold 5*a* and a communication hole extending from the pressure chamber 10 toward the ink ejecting opening 8. The manifold plates 24 are metal plates including, in addition to the sub-manifold 5*a*, a communication hole extending from the pressure chamber 10 toward the ink ejecting opening 8 for each pressure chamber 10 of the cavity plate 22. The cover plate 29 is a metal plate including, for each pressure chamber 10 of the cavity plate 22, a communication hole extending from the pressure chamber 10 to the ink ejecting opening 8. The nozzle plate 30 is a metal plate having, for each pressure chamber 10 of the cavity plate, one tapered ink ejecting opening 8 which serves as a nozzle.

The ten sheet members 21 through 30 are laminated after being aligned to form an ink channel 32 as shown in FIG. 4. This ink channel 32 extends upward from the sub-manifold 5*a*, and then horizontally at the aperture 12. The ink channel 32 then extends further upward, then horizontally at the pressure chamber 10, and then obliquely downward for a certain length in a direction away from the aperture 12, and then vertically downward toward the ink ejecting opening 8.

As shown in FIG. 6, the actuator unit 21 includes three piezoelectric sheets 41, 42 and 43 having substantially the same thickness of about 15 μm. The piezoelectric sheet 41 is configured to a plurality of segments provided only above the pressure chambers 10, respectively. Specifically, each segment of the piezoelectric sheet 41 has a similar shape viewed from the above as the pressure chamber 10 (i.e., 850 μm long and 250 μm wide), and the area thereof projected along the laminated direction is slightly smaller than that of the pressure chamber 10 so that the former is included in the latter.

These piezoelectric sheets 42 and 43 are continuous planar layers, and is arranged to extend over a plurality of pressure chambers 10 which are distributed within each of the ink ejecting areas 2 of the inkjet head 1. Since the piezoelectric sheets 42 and 43 extend over a plurality of pressure chambers 10 as the continuous planar layers, the mechanical rigidity thereof can be maintained, which improves the speed of response regarding ink ejection of the inkjet head 1.

A common electrode 34, having a thickness of about 2 μm, is formed between the uppermost piezoelectric sheet 41 and the piezoelectric sheet 42. Further, driving electrodes (individual electrode) 35 is formed for respective pressure chambers 10 on the top surface of the piezoelectric sheet 41 (see also FIG. 3). Each driving electrode 35 is approximately 1 μm thick. The driving electrode 35 are distributed over the piezoelectric sheet 41. However, no electrodes are provided between the piezoelectric sheets 42 and 43, which is immediately below the piezoelectric sheet 42, and below the piezoelectric sheet 43.

The common electrode 34 is grounded. Thus, each area of the common electrode 34 corresponding to the pressure chamber 10 is kept at the ground potential. The driving electrode 35 is connected to drivers (not shown) by separate lead wires (not shown), respectively, so that the potential of the driving electrodes can be controlled for each pressure chamber 10.

It should be noted that the common electrode 34 is not necessarily formed as one sheet extending over the whole area of the piezoelectric sheet, and a plurality of common electrodes 34 may be formed such that the projection thereof in the layer stacked direction covers the whole area of the pressure chamber 10, or such that the projection thereof is included within the area of the pressure chamber. In such cases, it is required that the common electrodes are electrically connected so that the areas thereof opposing the pressure chamber 10 are at the same potential.

In the inkjet head 1 according to the embodiment, the direction of polarization of the piezoelectric sheets 41 through 43 coincides with the thickness direction thereof. The actuator unit 21 is configured to form a so-called unimorph type actuator, in which one piezoelectric sheet 41 provided on the upper part (the sheet distant from the pressure chamber 10) is an active layer and the other two piezoelectric sheets 42 and 43 at the lower part (the sheets closer to the pressure chamber 10) are inactive layers. When the driving electrode 35 is set to a predetermined positive/negative potential, if the direction of electrical field coincides with the direction of polarization, the portion of the piezoelectric sheet 41, which is the active layer, contracts in a direction perpendicular to the polarization direction. In the meantime, the piezoelectric sheets 42 and 43, which are not affected by the electric field, do not contract. Thus, the upper layer piezoelectric sheet 41 and the lower layer piezoelectric sheets 42 and 43 deform differently in the polarization direction, and the piezoelectric sheets 41 through 43 as a whole deform such that the inactive layer side becomes convex (unimorph deformation). Since, as shown in FIG. 6, the bottom surface of the piezoelectric sheets 41 through 43 are fixed on the top surface of partitions 22, which define the pressure chambers 10, the pressure chamber side surface of the piezoelectric sheets 41 through 43 become convex. Accordingly, the volume of the pressure chamber 10 decreases, which increases the pressure of the ink and causes the ink to be ejected from the ink ejecting opening 8.

If, thereafter, the application of the driving voltage to the driving electrodes 35 is cut, the piezoelectric sheets 41 through 43 recover to the neutral shapes (i.e., a planar shape as shown in FIG. 6) and hence the volume of the pressure chamber 10 recovers (i.e., increases) to the normal volume, which results in suction of ink from the manifold 5.

Note that in an alternative driving method, the voltage is initially applied to the driving electrodes 35, cut on each ejection requirement and re-applied at a predetermined timing after certain duration. In this case, the piezoelectric sheets 41 through 43 recover their normal shapes when the application of voltage is cut, and the volume of the pressure chamber 10 increases compared to the initial volume (i.e., in the condition where the voltage is applied) and hence ink is drawn from the manifold 5. Then, when the voltage is applied again, the piezoelectric sheets 41 through 43 deform such that the pressure chamber side thereof become convex to increase the ink pressure by reducing the volume of pressure chamber, and thus the ink is ejected.

If the direction of the electric field is opposite to the direction of polarization, the portions of the piezoelectric sheet 41, which is the active layer sandwiched by the electrodes, expands in a direction perpendicular to the polarization direction. Accordingly, in this case, the portions of the piezoelectric sheet 41 sandwiched by electrodes 34 and 35 bend by piezoelectric transversal effect so that the pressure chamber side surfaces become concave. Thus, when the voltage is applied to the electrodes 34 and 35, the volume of the pressure chamber 10 increases and ink is drawn from the manifold 5. Then, if the application of the voltage to the driving electrodes 35 is stopped, the piezoelectric sheets 41 through 43 recover to their normal form, and hence the volume of the pressure chamber 10 recovers to its normal volume, thereby the ink being ejected from the nozzle.

The inkjet head 1 can enhance the electrical efficiency (i.e., change of the volume of the pressure chamber 10 per unit electrostatic capacity) or the area efficiency (i.e., change of the volume of the pressure chamber 10 per unit projected area) compared to those of the inkjet head having the active layer at the pressure chamber side and the inactive layer at the opposite side as described in the previously mentioned publication, since it has a plurality of piezoelectric sheets 42 and 43 as inactive layers. The improvement in electrical efficiency or area efficiency enables downsizing of the drivers for the driving electrodes 35, which contributes to decrease the manufacturing cost thereof. Further, the pressure chambers 10 can be made compact. Even if the pressure chambers 10 are highly integrated, sufficient amount of ink can be ejected. Therefore, downsizing of the inkjet head 1 and high density of the printed dots can be achieved. This effect is improved when a plurality of active layers are provided. For example, when the number of the active layers is four or more, a significant effect is expected.

Figure 7:
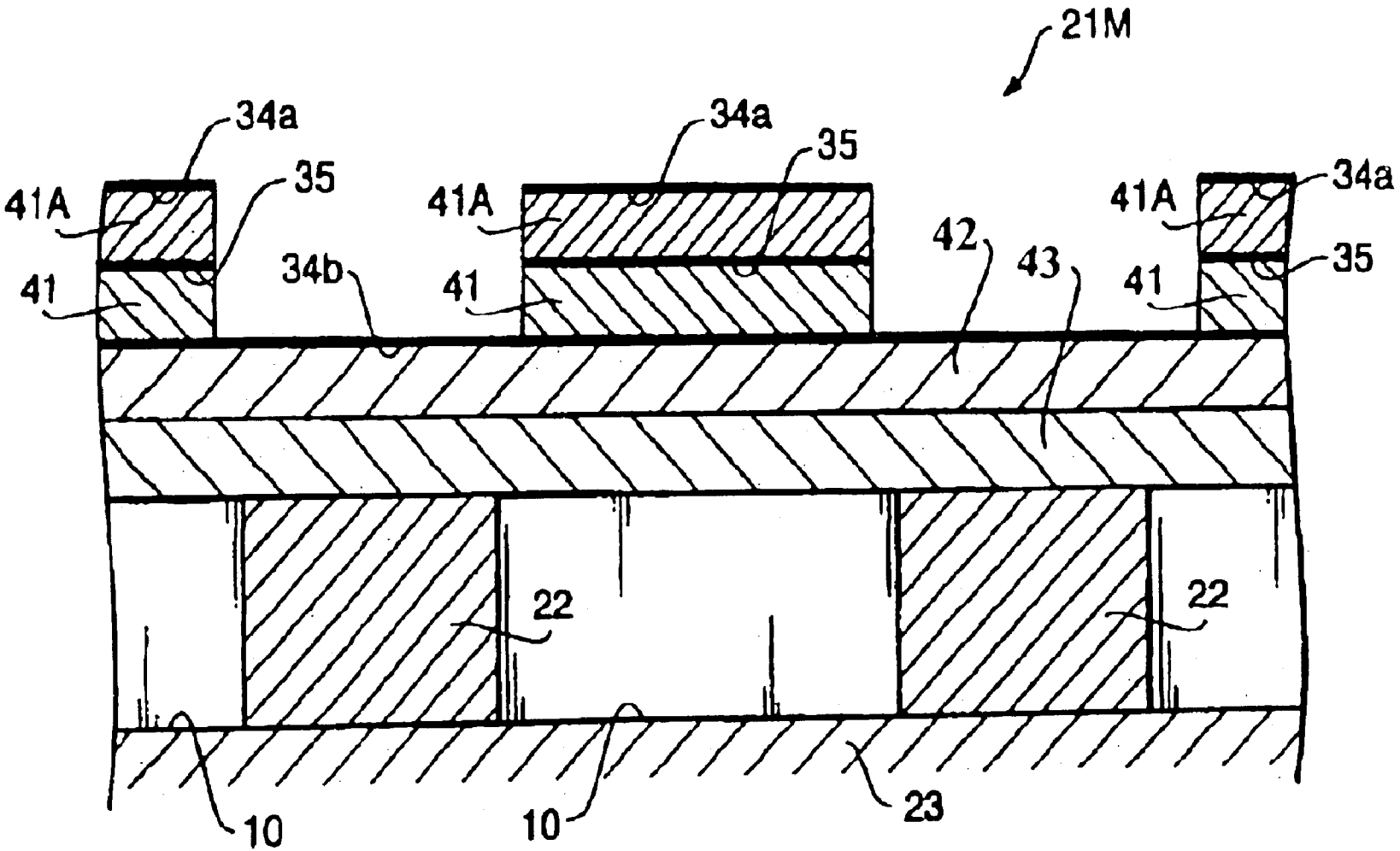
FIG. 7 shows a modification of the structure shown in FIG. 6.

FIG. 7 shows a modification of the embodiment. In the configuration shown in FIG. 7, an actuator unit 21M has two active layers (i.e., piezoelectric sheets 41 and 41A) and two inactive layers (i.e., piezoelectric sheets 42 and 43). In this example shown in FIG. 7, above each driving electrode 35, another active layer 41A is provided, and another common electrode 34*a* is provided above the active layer 41A. With this configuration, as described above, an improved effect can be expected.

Further, according to the inkjet head 1, a plurality of inactive layers 42 and 43 are provided. With this configuration, in comparison with a case where a single thick sheet of inactive layer is provided, fabrication there of is easier. Further, since the active and inactive layers are formed of the same material, when they are fabricated by baking, they contract at the same contraction percentage, which improves the dimensional accuracy.

The above-mentioned effect is remarkable since, in the inkjet head 1, the thickness of the active layer, i.e., the piezoelectric sheet 41, is relatively thin, i.e., 15 $\mu$m. It is desirable to keep the thickness of the piezoelectric sheet 41 at 20 $\mu$m or lower in order to improve the electrical efficiency or area efficiency.

Further, in the inkjet head 1, the total thickness of the active layers and the inactive layers (the total thickness of the piezoelectric sheets 41 through 43) is 45 $\mu$m, and the thickness of the active layer (the thickness of the piezoelectric sheet 41) is 15 $\mu$m, and hence the ratio of the two is 15/45=0.33. Because of this configuration, the above-mentioned effect is further remarkable in the inkjet head 1.

From the viewpoint of improving electrical efficiency or area efficiency, it is preferably that t/T is 0.8 or lower, and more preferably 0.7 or lower, where T represents the total thickness of the active and inactive layers (the total thickness of the piezoelectric sheets 41 through 43), and t represents the thickness of the active layer (the thickness of the piezoelectric sheet 41).

The above-mentioned effect is remarkable in the inkjet head 1 according to the embodiment, since the length of the pressure chamber 10 in the transverse direction is 350 $\mu$m, and the length (activation width) of the driving electrode 35 in the same direction is 250 $\mu$m, and hence the ratio of the two is 250/3504=0.714 . . . . From the viewpoint of improving electrical efficiency and area efficiency, it is preferable that conditions 0.1 mm $\leqq L \leqq 1$ mm and $0.3 \leqq \delta/L \leqq 1$ are satisfied, where L represents the length of the pressure chamber in the transverse direction and $\Delta$ represents the length of the driving electrode 35 in the direction the same as that of length L.

Further, the electrode located at the most pressure chamber side among the electrodes employed in the inkjet head 1 (i.e., electrodes 34 and 35) is utilized as the common electrode (34). This configuration prevents unstable printing due to the effect of potential variation of the driving electrode 35 on the ink, which has conductivity.

In the embodiment, the piezoelectric sheets 41 through 43 are made of Lead Zirconate Titanate (PZT) material which shows ferroelectricity. The electrodes 34 and 35 are made of metal of, for example, Ag—Pd metal.

The actuator unit 21 is made by stacking the ceramic material for the piezoelectric sheet 43, the ceramic material for piezoelectric sheet 42, the metal material for the common electrode 34 and the ceramic material for the piezoelectric sheet 41, and then the stack of the sheets 43, 42, 34 and 41 is baked. Thereafter, the piezoelectric sheet 41 is formed to have the shape corresponding to the pressure chamber 10 as described above by means of ultra-sonic honing, or cutting with dicer. Then, metal material for the driving electrode 35 is plated on the surface of the piezoelectric sheet 41, and unnecessary portions thereof are removed by means of laser patterning.

Alternatively, the driving electrode 35 may be coated on the piezoelectric sheet 41 by means of vapor deposition using a mask having an opening.

In contrast to other electrodes, the driving electrodes 35 are not baked together with the ceramic materials of the piezoelectric sheets 41 through 43. This is because the driving electrodes 35 are exposed to outside and therefore are easy to vaporize when they are baked at high temperature which makes the control of the thickness of the driving electrodes 35 relatively difficult compared to the common electrode 34 which is covered with the ceramic materials. The thickness of the common electrode 34 also decreases more or less when baked. Therefore, it is difficult to make the common electrode 34 thin with keeping the same continuity even after baking. The driving electrodes 35 can be made as thin as possible in contrast with the common electrode 34 since the driving electrodes 35 are formed after the baking as described above.

As above, in the inkjet head 1 according to the embodiment, the driving electrode 35 on the most upper layer, are made thinner than the other electrode 34 and therefore do not obstruct the displacement of the piezoelectric sheet 41 (i.e., the active layer) so much, which in turn improves the efficiency (electrical efficiency and area efficiency) of the actuator unit 21.

In the inkjet head 1, the piezoelectric sheet 41, or the active layer, and the piezoelectric sheets 42 and 43, or the inactive layers, are made of the same material. Accordingly, the inkjet head 1 can be produced by a relatively simple manufacturing process, which does not require exchange of materials. Therefore, reduction of manufacturing cost is expected. Further, since all of the piezoelectric sheets 41 through 43 have substantially the same thickness, the manufacturing process of the piezoelectric sheets can be simplified, which further reduces the manufacturing cost. This is because, it is possible to simplify the process for adjusting the thickness of the ceramic materials stacked for forming the piezoelectric sheets.

In addition, in the inkjet head 1 according to the embodiment, the actuator units 21 are sectionalized for respective ink ejecting areas 2. This is because, if the actuator units 21 are formed uniformly, the small displacement between the cavity plate 22 and the actuator unit 21 overlaid thereon increases at the distance farther from the alignment point and may result in large displacements of the driving electrodes 35 of the actuator unit 21 from the corresponding pressure chambers 10. According to the embodiment, such displacements hardly occur and a good accuracy of alignment can be achieved.

The preferred embodiment of the invention has been described in detail. It should be noted that the invention is not limited to the configuration of the above described exemplary embodiment, and various modification are possible without departing the gist of the invention.

For example, the materials of the piezoelectric sheets and the electrodes are not limited to those mentioned above, and can be replaced with other appropriate materials. Further, the planar shape, the sectional shape, and the arrangement of the pressure chambers may be modified appropriately. The numbers of the active and inactive layers may be changed under the condition that the number of the inactive layers is two or more. Further, the active and the inactive layers may have different thicknesses.

The present disclosure relates to the subject matter contained in Japanese Patent Application No. 2001-365513, filed on Nov. 30, 2001, which is expressly incorporated herein by reference in its entirety.

What is claimed is:

1. An inkjet head, comprising:

a plurality of pressure chambers, each of which being configured such that an end thereof is connected to a discharging nozzle and the other end is connected to an ink supplier; and an actuator unit for the plurality of pressure chambers, said actuator unit including:

a plurality of inactive layers made of piezoelectric material, said plurality of inactive layers being arranged on a pressure chamber side to cover said plurality of pressure chambers; and at least one active layer made of piezoelectric material, said at least one active layer being arranged on an opposite side of said pressure chambers with respect to said plurality of inactive layers, said at least one active layer being segmented so as to correspond to said plurality of pressure chambers, wherein each segment of said at least one active layer is sandwiched between a common electrode and a driving electrode.

2. The inkjet head according to claim 1, wherein when said driving electrodes are set to have voltage different from the potential of said common electrode, said at least one active layer deforms in accordance with piezoelectric transverse effect, a unimorph effect being generated by the deformation of said active layer in association with the inactive layers to vary a volume of said pressure chambers.

3. The inkjet head according to claim 1, wherein said at least one active layer includes a plurality of active layers.

4. The inkjet head according to claim 1, an electrode arranged farthest from the pressure chamber is configured to be the thinnest electrode between said common electrode and said driving electrode.

5. The inkjet head according to claim 1, wherein an electrode closest to the pressure chamber is said common electrode.

6. The inkjet head according to claim 1, wherein a thickness of each of said at least one active layer is 20 $\mu$m or less.

7. The inkjet head according to claim 1, wherein t/T is 0.8 or less, where t represents a thickness of said active layer and T represents the entire thickness of said active layers and said inactive layers.

8. The inkjet head according to claim 7, wherein t/T is 0.7 or less.

9. The inkjet head according to claim 1, wherein:

a width of said active layer in a shorter side is between 0.1 mm and 1 mm, and a ratio of a width of a driving electrode, in a direction similar to the width of said active layer, to the width of said active layer is between 0.3 and 1.

10. The inkjet head according to claim 1, wherein all of said at least one active layer and said at least one inactive layer are formed of the same material.

11. The inkjet head according to claim 1, wherein all of said at least one active layer and said inactive layers have substantially the same thickness.

12. The inkjet head according to claim 1, wherein a number of the at least one active layer and a number of the plurality of inactive layers are one and two, respectively.

13. The inkjet head according to claim 1, wherein a number of the at least one active layer and a number of the plurality of inactive layers are two and two, respectively.

14. The inkjet head according to claim 1, wherein said common electrode is kept to a ground potential.

15. An inkjet head, comprising:

a plurality of pressure chambers, each of which being configured such that an end thereof is connected to a discharging nozzle and the other and is connected to an ink supplier; and an actuator unit for the plurality of pressure chambers, wherein said actuator unit includes a plurality of inactive layers arranged on a pressure chamber side and formed of piezoelectric material and at least one active layer, arranged on an opposite side of said pressure chambers with respect to said inactive layers and formed of piezoelectric material, said plurality of inactive layers being arranged to cover said plurality of pressure chambers, said at least one active layer being segmented to locate at positions corresponding to said plurality of pressure chambers, wherein each segment of said at least one active layer is sandwiched between a common electrode and a driving electrode, and wherein each segment of said at least one active layer sandwiched between the common electrode and the driving electrode deforms in accordance with piezoelectric transverse deformation effect so that said each segment performs unimorph deformation in accordance with a voltage applied to each of said driving electrode.

16. The inkjet head according to claim 15, wherein said common electrode is kept to a ground potential.

* * * * *